US010107030B2

(12) United States Patent
Raffi et al.

(10) Patent No.: US 10,107,030 B2
(45) Date of Patent: Oct. 23, 2018

(54) SECURITY GATE

(71) Applicant: Dorel Juvenile Group, Inc., Foxboro, MA (US)

(72) Inventors: Laura Kay Raffi, Holliston, MA (US); Caroline M. Hunter, Braintree, MA (US); Paul Dowd, Scarsdale, NY (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 29 days.

(21) Appl. No.: 15/405,569

(22) Filed: Jan. 13, 2017

(65) Prior Publication Data

US 2017/0211314 A1 Jul. 27, 2017

Related U.S. Application Data

(60) Provisional application No. 62/287,680, filed on Jan. 27, 2016.

(51) Int. Cl.

| | |
|---|---|
| ***E06B 9/04*** | (2006.01) |
| ***E06B 9/02*** | (2006.01) |
| *E06B 9/00* | (2006.01) |

(52) U.S. Cl.

CPC ..... *E06B 9/04* (2013.01); *E06B 9/02* (2013.01); *E06B 2009/002* (2013.01)

(58) Field of Classification Search

CPC ..... E06B 2009/002; E06B 9/04; E06B 9/02; E05B 65/0014

See application file for complete search history.

(56) References Cited

U.S. PATENT DOCUMENTS

| | | | | |
|---|---|---|---|---|
| 4,677,791 | A * | 7/1987 | Larson | E06B 9/02 160/215 |
| 5,272,840 | A | 12/1993 | Knoedler et al. | |
| 5,442,881 | A | 8/1995 | Asbach et al. | |
| 5,528,859 | A | 6/1996 | Taylor et al. | |
| 5,570,543 | A * | 11/1996 | Bishop | E05B 65/0014 160/216 |
| 5,657,809 | A * | 8/1997 | Longoria | E06B 9/04 160/160 |
| 5,797,218 | A * | 8/1998 | Holland | E06B 9/04 49/55 |
| 6,016,629 | A * | 1/2000 | Sylvester | E05B 65/0007 49/394 |
| 6,112,461 | A | 9/2000 | Cheng | |
| 6,253,490 | B1 | 7/2001 | Postans | |
| 6,536,163 | B1 | 3/2003 | Monahan et al. | |
| 7,627,985 | B2 | 12/2009 | Marsden et al. | |
| 7,963,575 | B2 | 6/2011 | Mayo et al. | |

(Continued)

FOREIGN PATENT DOCUMENTS

WO 2016187185 A1 11/2016

OTHER PUBLICATIONS

International Search Report and Written Opinion, International Application No. PCT/US2017/013320, dated May 31, 2017, 12 pages.

(Continued)

*Primary Examiner* — Justin B Rephann

(74) *Attorney, Agent, or Firm* — Barnes & Thornburg LLP

(57) ABSTRACT

A gate unit includes a gate mount that can be mated with a frame bordering a doorway, hallway, or staircase. The gate unit also includes a gate mounted for pivotable movement on the gate mount between opened and closed positions.

29 Claims, 5 Drawing Sheets

(56) References Cited

U.S. PATENT DOCUMENTS

| | | | | |
|---|---|---|---|---|
| 8,418,407 | B2 | 4/2013 | Wang | |
| 8,733,017 | B2 | 5/2014 | Marsden et al. | |
| 9,366,075 | B2 | 6/2016 | Marsden et al. | |
| 2001/0000556 | A1 | 5/2001 | Rossman et al. | |
| 2007/0131921 | A1* | 6/2007 | Monahan | E06B 9/04 256/73 |
| 2009/0013606 | A1* | 1/2009 | Yates | E06B 9/04 49/463 |
| 2009/0071074 | A1* | 3/2009 | Yates | E06B 9/04 49/55 |
| 2009/0293363 | A1* | 12/2009 | Flannery | E06B 7/32 49/55 |
| 2011/0088323 | A1* | 4/2011 | Lundh | E05B 43/00 49/57 |
| 2011/0175046 | A1* | 7/2011 | Flannery | E06B 9/04 256/73 |
| 2011/0289852 | A1* | 12/2011 | Dunn | B65D 77/0413 49/460 |
| 2015/0075079 | A1 | 3/2015 | Sundberg et al. | |
| 2015/0089873 | A1 | 4/2015 | Marsden et al. | |
| 2015/0101250 | A1 | 4/2015 | Marsden | |
| 2015/0101253 | A1 | 4/2015 | Marsden et al. | |
| 2017/0292325 | A1* | 10/2017 | Biesinger | E05B 65/0007 |

OTHER PUBLICATIONS

Invitation to Pay Additional Fees issued by the International Search Authority in connection with International Application No. PCT/US17/13320. dated Apr. 5, 2017, 2 pages.

* cited by examiner

SECURITY GATE

PRIORITY CLAIM

This application claims priority under 35 U.S.C. § 119(e) to U.S. Provisional Application No. 62/287,680, filed Jan. 27, 2016, which is expressly incorporated by reference herein.

BACKGROUND

The present disclosure relates to movable barriers, and particularly to security gates. More particularly, the present disclosure relates to variable-width security gates for use at the top of a stairway or in a doorway inside a dwelling.

SUMMARY

According to the present disclosure, a gate unit includes a gate that can be moved in a doorway or at the top of a staircase about a pivot axis by a person between opened and closed positions. In the closed position, the gate is positioned to block movement through the doorway or onto the staircase.

In illustrative embodiments, the gate unit includes a gate mount that is adapted to mate with a door frame bordering a doorway, a hall frame bordering a hallway, or a staircase frame bordering an entry to a staircase. The gate mount includes hinge-side frame mount coupled to a hinge-side end of the gate and adapted to mate with one side of the doorway, hallway, or staircase frame. The gate mount also includes a lock-side frame mount adapted to mate with an opposite side of the doorway, hallway or staircase frame and to a lock-side end of the gate when the gate is moved to assume the closed position.

In illustrative embodiments, the gate unit is pre-assembled and supported for shipping in packaging as a single unit using a gate spacer provided between the lock-side frame mount and the lock-side end of the gate and two floor spacers provided along a bottom edge of the gate. Zip-tie connectors are used to anchor the lock-side end of the gate in a stationary position relative to the lock-side frame mount and to trap the gate spacer in a fixed position between the lock-side frame mount and the lock-side end of the gate.

In illustrative embodiments, during installation on a doorway or staircase frame, the pre-assembled gate unit is removed from the shipping packaging and the gate spacer is retained in a trapped position between the lock-side frame mount and the lock-side edge of the gate by means of the zip-tie connectors. The pre-assembled gate unit is carried to a doorway or staircase by a consumer. The two floor spacers that came in the packaging are placed on the floor (e.g. one adjacent to the lock-side frame mount and the other adjacent to the hinge-side frame mount) and the pre-assembled gate is placed in an opening provided between the lock-side and hinge-side frame mounts and lowered to rest in a ready-to-install position on the underlying floor spacers that set on the floor.

In illustrative embodiments, the lock-side vertical frame includes a first vertical plate and at least one rotatable frame anchor that is mounted on the vertical plate for rotation about a horizontal rotation axis from a vertical shipping orientation aligned with the first vertical plate through a 90° angle to assume a horizontal anchoring orientation extended at a right angle to the vertical plate. Each rotatable frame anchor includes a rotating screw-carrier bracket and two fasteners (e.g., frame dog screws) that are carried on the rotating screw-carrier bracket. The two frame dog screws are pre-installed and retained on the rotating screw-carrier bracket during shipping. The two frame dog screws are moved relative to the first vertical plate from a shipping position to a ready-to-engage-a-frame position during rotation of the rotatable frame anchor about the horizontal rotation axis from the vertical shipping orientation to the horizontal anchoring orientation. Once the frame dog screws are located in the ready-to-engage-a-frame position, they can be moved by the consumer to engage the frame to anchor the gate unit to the frame. Then the consumer can remove all the spacers from the gate unit.

In illustrative embodiments, the following process is used to install an assembled gate unit in accordance with the present disclosure in a door, hallway, or staircase frame. The assembled gate unit is removed from the shipping packaging, placed in a doorway or opening, and adjusted to fit the width of the doorway or opening. Each rotatable frame anchor is anchored to its companion frame by unfolding a paper template that is provided in the frame mount for each rotatable frame anchor to cause the paper template to lie along the adjacent frame, pre-drilling fastener pilot holes in the adjacent frame through drill-locator targets printed on the paper template, rotating the screw-carrier bracket about the horizontal rotation axis to align each of the pre-installed frame dog screws with one of the pre-drilled fastener pilot holes, and driving each frame dog screw into a companion pre-drilled fastener pilot hole using a screw driver. Finally, the zip-tie connectors and the gate and floor spacers are removed from the gate and gate mount. The gate is retained in the closed position using an on-board gate lock system coupled to the gate and gate mount. The gate is ready to be opened.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of an assembled gate unit in accordance with the present disclosure wrapped in gate-unit packaging with portions of the packaging broken away to reveal that the gate unit is pre-assembled and supported for shipping in the packaging using a gate spacer and first and second floor spacers also shown in FIG. 2 that are configured to support the assembled gate unit in a doorway or hallway or at the top of a stairway when the assembled gate unit is unpackaged to allow a single user to mount the assembled gate unit in the hallway as suggested in FIG. 3 and to assume an installed position as shown in FIG. 4;

FIG. 2 is a perspective view of the assembled gate unit of FIG. 1 showing that the assembled gate unit can be removed intact from the gate-unit packaging and separated from the gate spacer and two floor spacers in preparation for installation in a hallway as suggested in FIG. 3 or in a doorway or at the top of a stairway and showing that the assembled gate unit includes a gate mount comprising a lock-side frame mount provided on the left and a hinge-side frame mount provided on the right and a gate arranged to extend between the lock-side and hinge-side frame mounts;

FIG. 3 is a front elevation view of the assembled gate unit of FIGS. 1 and 2 after it has been placed in a hallway in a dwelling and showing that the floor spacers that were used to support the assembled gate unit in the gate-unit packaging during shipping are now re-purposed and used to support the assembled gate unit in an upright position in the hallway at a proper elevated installation height and showing that the gate spacer remains held in place by a pair of zip-tie connectors between the lock-side frame mount and a left-side portion of an extension panel of an extensible gate to locate the lock-side frame mount in a predetermined position relative to the extensible gate during installation;

FIG. 4 is a view similar to FIG. 3 showing the assembled gate unit mating with the adjacent frame and suggesting that the gate spacer, the first and second floor spacers, and the gate instructions panel shown in FIG. 3 may be discarded after the gate unit is mounted in the hallway and suggesting that the gate unit illustratively includes a two-stage gate release carried on the extensible gate and configured to engage with latch receivers coupled to the lock-side frame mount of the gate mount to lock the gate in the closed position;

FIG. 5A is a perspective view of the gate unit of FIGS. 1-4 after the assembled gate unit has been removed from the gate-unit packaging and separated from the gate and floor spacers and showing that the lock-side vertical frame mount includes a first vertical plate provided on the left and configured to mate with movable latch pins included in a latch system coupled to the left edge of the extension panel of the extensible gate and the hinge-side vertical frame mount includes a second vertical plate provided on the right and configured to mate with vertical rotation-support pins included in a hinge system coupled to the right edge of the main panel of the extensible gate and also showing that a first pair of first and second rotatable frame anchors are included in the lock-side vertical frame mount and coupled to the first vertical plate and that a second pair of first and second rotatable frame anchors are included in the hinge-side vertical frame mount and coupled to the second vertical plate, and suggesting that each rotatable frame anchor is rotatable about a horizontal rotation axis to assume a vertical shipping orientation;

Figure 3:
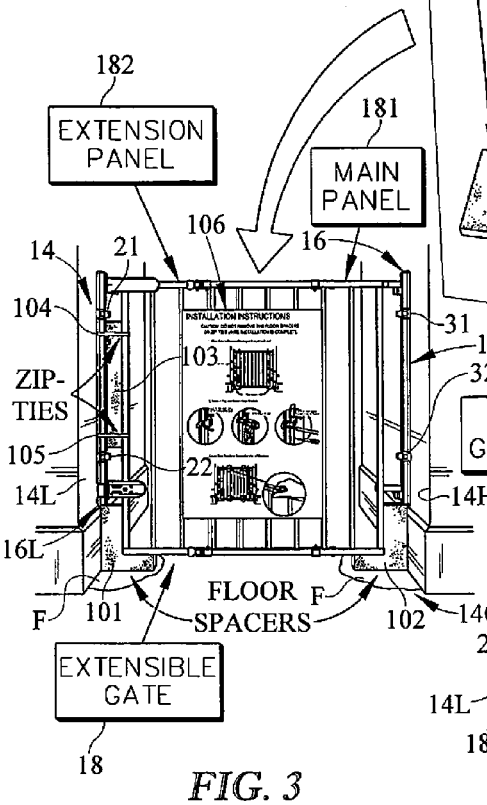
Figure 7:
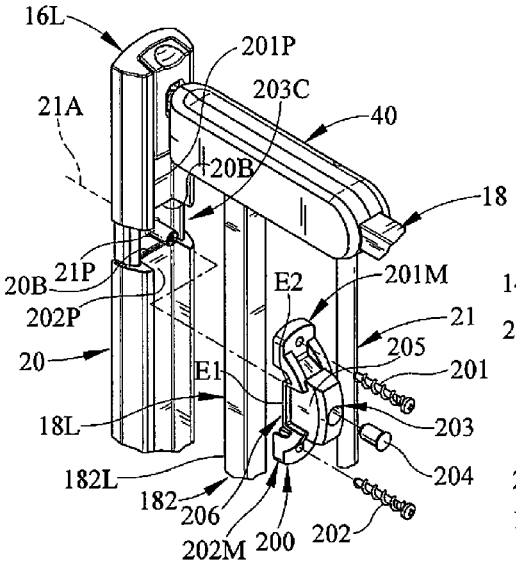
Figure 8:
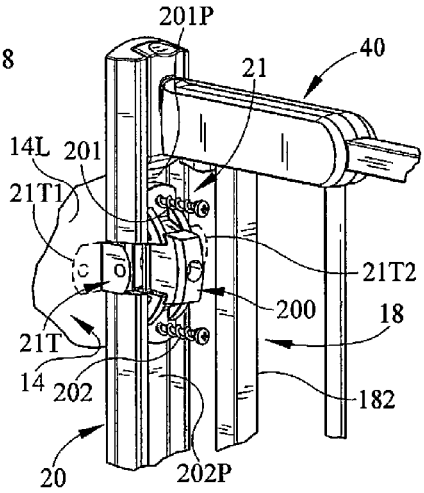
Figure 9:
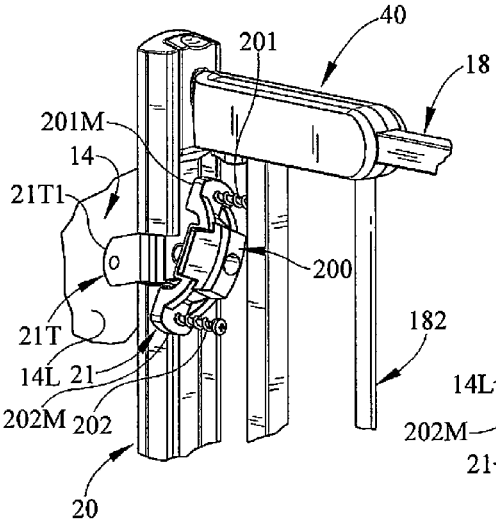
Figure 10:
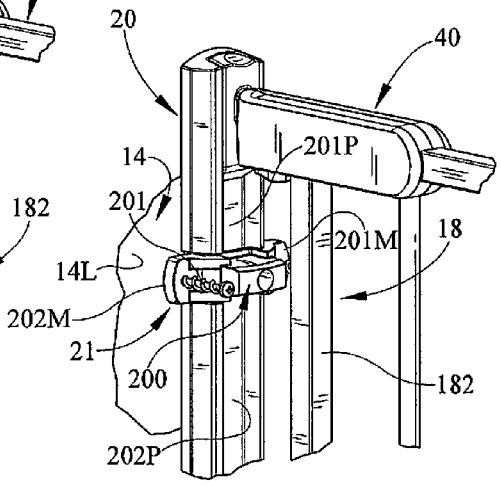
Figure 11:
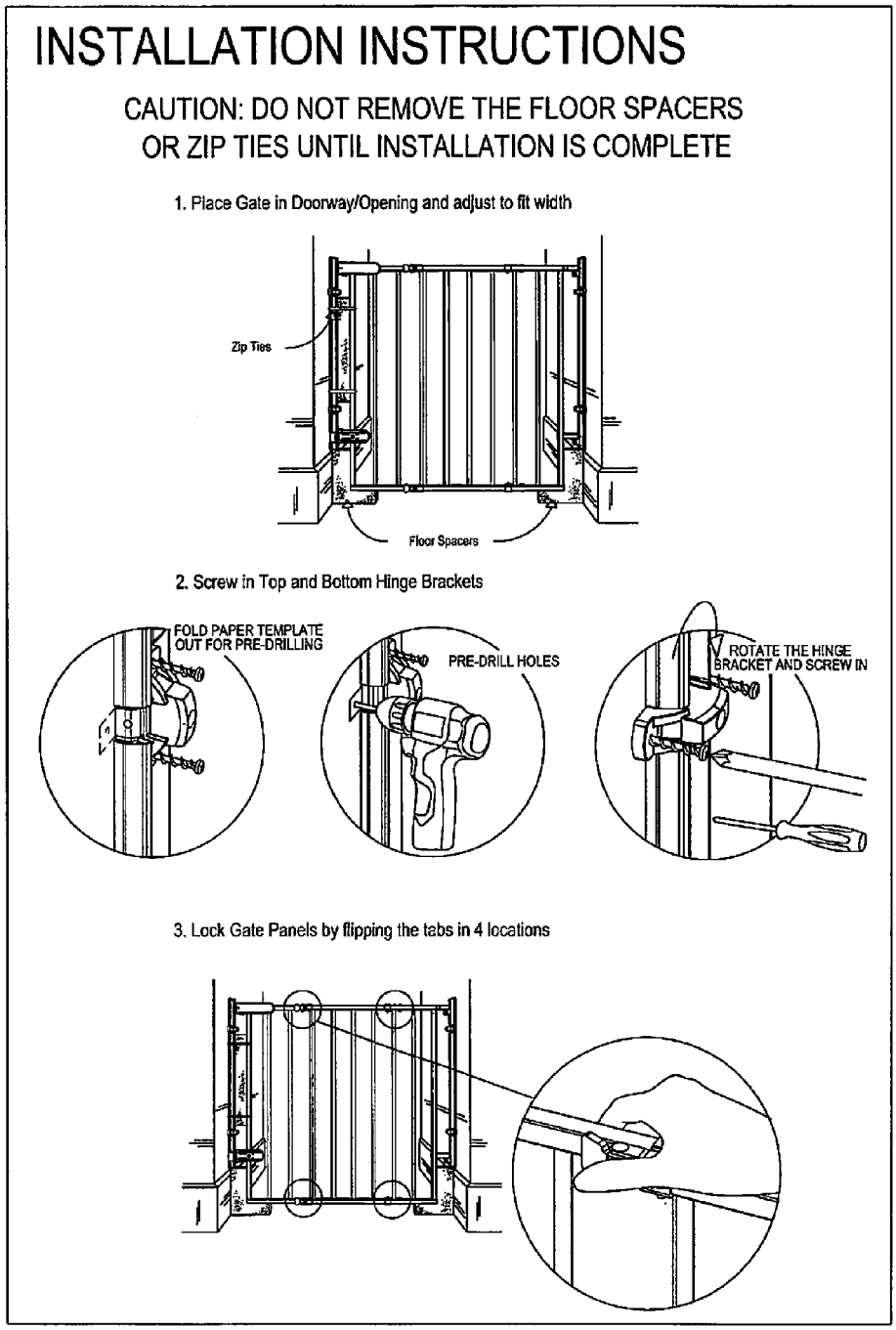

FIG. 7 is an enlarged perspective assembly view of the first rotatable anchor before it is coupled to a rotation-support sleeve included in an upper portion of the lock-side vertical frame mount and showing that the first rotatable anchor comprises a rotating screw-carrier bracket, two frame dog screws that are pre-installed and carried on the rotating screw-carrier bracket, and a sleeve cap configured to mate with the rotation-support sleeve and cooperate therewith to support the rotating screw-carrier bracket for rotation about a first horizontal rotation axis;

FIG. 8 is a view similar to FIG. 7 after assembly of the first rotatable anchor and showing orientation of the first rotatable anchor in the vertical shipping orientation and showing that the first rotatable anchor illustratively also includes a fold-out paper pilot-hole template comprising a foldable left-side flap marked with a first pilot-hole mark for the first frame dog screw and a foldable right-side flap marked with a second pilot-hole mark for the second frame dog screw and suggesting that each flap can be pivoted outwardly toward a frame (e.g. wall) by a gate installer once the lock-side vertical frame mount is mated with the frame to show where pilot holes should be drilled to receive the frame dog screws;

FIG. 9 is a view similar to FIG. 8 showing partial rotation of the screw-carrier bracket about the first horizontal rotation access after two pilot holes have been drilled in the frame (e.g. wall) using the unfolded left-side and right-side flaps of the fold-out paper pilot-hole template included in the first rotatable anchor and showing that the two frame dog screws have been pre-installed on the screw-carrier bracket to rotate therewith from the initial position shown in FIG. 8 to the final position shown in FIG. 10;

FIG. 10 is a view similar to FIGS. 8 and 9 showing the first rotatable anchor after it has been rotated to assume the horizontal anchoring orientation and the two frame dog screws have been screwed into the two pilot holes; and FIG. 11 is an enlarged view of the installation instructions that are attached at a factory to the extensible gate in a shipping position shown, for example, in FIG. 3.

DETAILED DESCRIPTION

Figure 1:
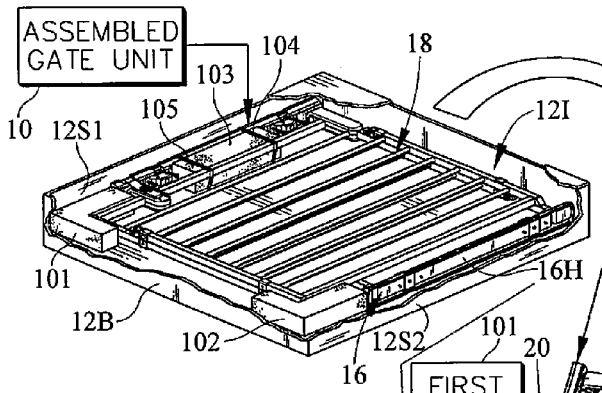

Gate unit 10 is pre-assembled at a factory in illustrative embodiments of the present disclosure and placed in gate-unit packaging 12 for shipping to consumers as suggested in FIG. 1. The assembled gate unit 10 can be removed in one piece from packaging 12 as suggested in FIG. 2 and various spacers 101, 102, and 103 that were used initially to support the assembled gate unit 10 in packaging 12 can also be used as suggested in FIG. 3 to support the assembled gate unit 10 in a proper elevated installation position relative to a doorway, hallway, or staircase frame 14 as suggested in FIG. 3. Rotatable frame anchors 21, 22, 31, and 32 included in assembled gate unit 10 can be used as suggested in FIGS. 7-11 to anchor assembled gate unit 10 to the adjacent doorway, hallway, or staircase frame 14 while the assembled gate unit 10 is supported in the proper elevated installation position by the various spacers 101, 102, and 103 as suggested in FIG. 3.

Figure 2:
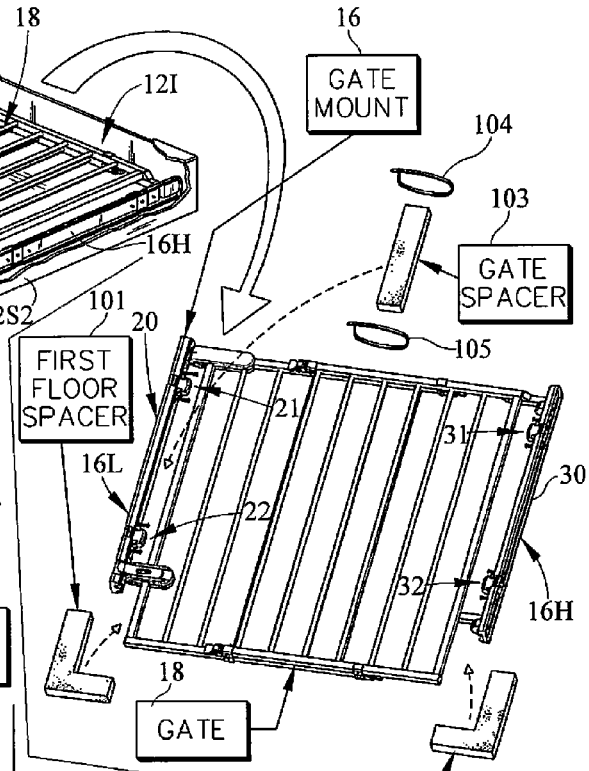
Figure 4:
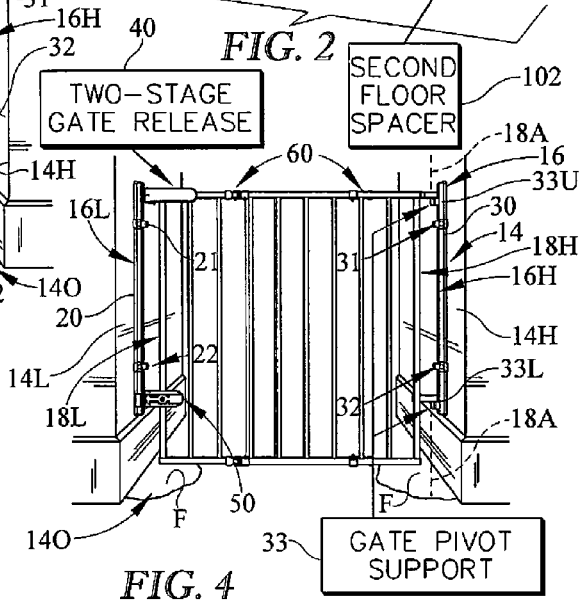

Gate unit 10 includes a gate mount 16 and a swinging gate 18 as suggested in FIGS. 2-4. Gate mount 16 is adapted to mate with opposing frame portions 14A, 14B of a doorway, hallway, staircase, or other frame 14 as suggested in FIG. 4. Although each of the frame portions 14A, 14B illustrated in FIG. 3 is a portion of a wall, it is also within the scope of the present disclosure to attach gate mount 16 of gate unit 10 to door jambs, staircase posts, or other suitable frame portions to support gate 16 for swinging movement about a vertical pivot axis 16A between opened and closed positions.

As suggested in FIG. 4, gate mount 16 includes a first (hinge-side) frame mount 16H that is adapted to be held in a stationary position on hinge-side frame portion 14H and a second (lock-side) frame mount 16L that is adapted to be held in a stationary position on an opposing lock-side frame portion 14L. A hinge-side end 18H of gate 18 is pivotably coupled to hinge-side frame mount 16H at vertical pivot axis 18A. An opposite lock-side end 18L of gate 18 is arranged to engage the lock-side frame mount 16H when gate 18 is swung about the vertical pivot axis 18A to assume the closed position.

Lock-side frame mount 16L includes a vertical frame plate 20 that is adapted to mate with lock-side frame portion 14L and a first pair of first and second rotatable frame anchors 21, 22 as shown in FIG. 4. Each of rotatable frame anchors 21, 22 is mounted on vertical frame plate 20 for rotation about a horizontal rotation axis 21A or 22A from a vertical shipping orientation shown in FIGS. 11-3 and 8 to a horizontal anchoring orientation shown in FIGS. 4 and 10.

Hinge-side frame mount 16H includes a vertical frame plate 30 that is adapted to mate with hinge-side frame portion 14H and a second pair of first and second rotatable frame anchors 31, 32 as shown in FIG. 4. Each of rotatable frame anchors 31, 32 is mounted on vertical frame plate 30 for rotation about a horizontal rotation axis 31A or 32A from a vertical shipping orientation shown in FIGS. 1-3 and 8 to a horizontal shipping orientation shown in FIGS. 4 and 10.

Gate 18 is extensible to fit the width of many frame openings and includes a barrier wall 180 defined by overlapping movable main and extension panels 181, 182. The main panel 181 is mounted on hinge-side frame mount 16H for swinging movement about vertical pivot axis 18A. The extension panel 182 is mounted for sliding movement on main panel 181 toward and away from vertical pivot axis 18A at the option of a user to widen or narrow the width of the barrier wall 180.

Gate unit 10 is pre-assembled to cause (1) the hinge-side frame mount 16H to be coupled initially to a hinge-side end 181H of main panel 181 for movement therewith and (2) the lock-side frame mount 16L to be coupled initially to a lock-side end 182L of extension panel 182 so that the hinge-side and lock-side frame mounts 16H, 16L are moved away from one another in response to relative movement of the main and extension panels 181, 182 to widen barrier wall 180 and extensible gate 18 during gate installation. Alternatively, the hinge-side and lock-side frame mounts 16H, 16L are moved toward one another in response to relative movement of the main and extension panels 181, 182 to narrow barrier wall 180 and extensible gate 18 during gate installation.

Hinge-side frame mount 16H also includes a gate-pivot support 33 as suggested in FIG. 4. Gate-pivot support 33 is configured to include upper and lower hinges 33U, 33L as suggested in FIGS. 4 and 5A.

Figure 6:
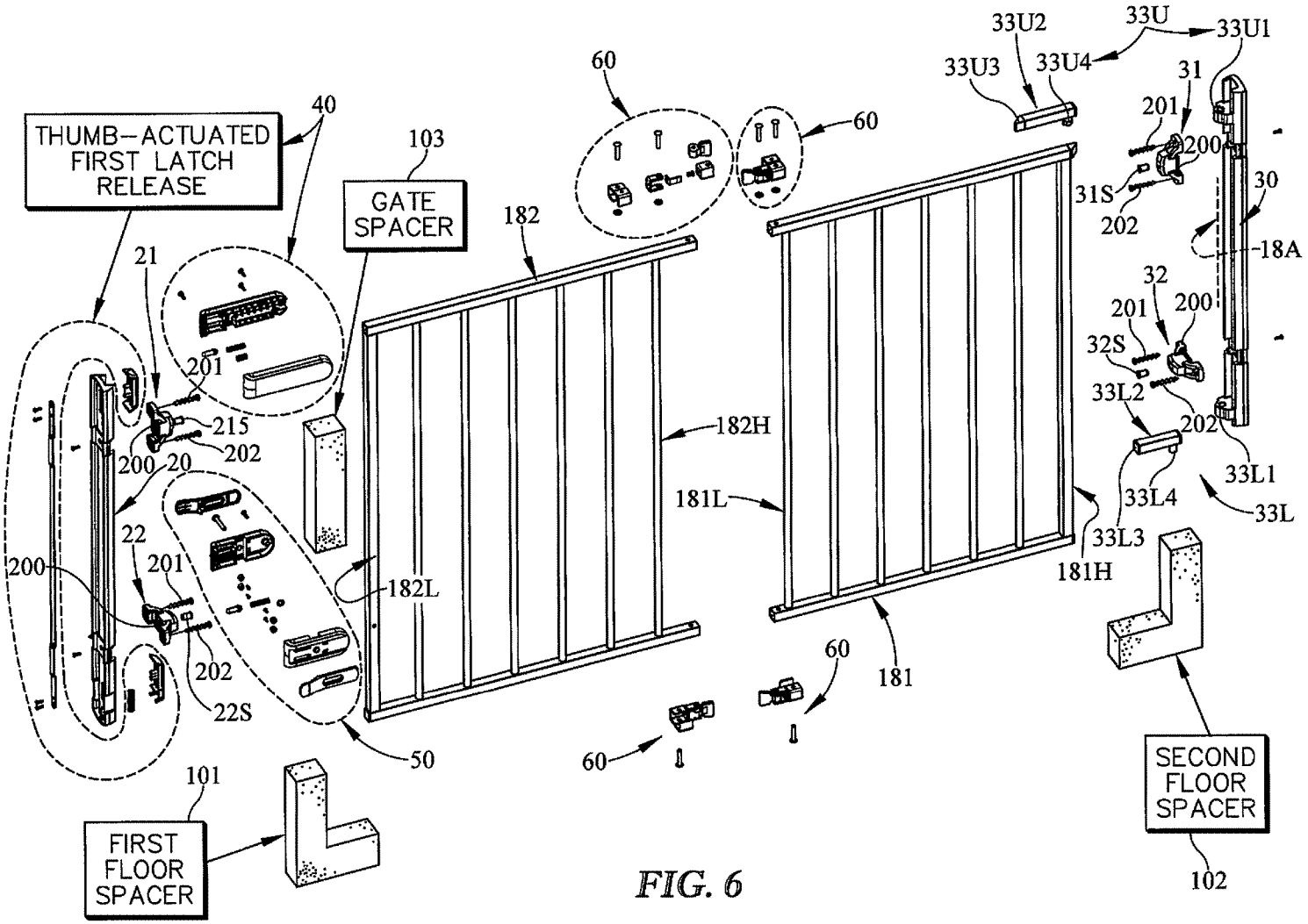
FIG. 6 is an exploded perspective assembly view of the assembled gate unit of FIGS. 1-5 and also shows the gate spacer and the first and second floor spacers.

Upper hinge 33U of gate-pivot support 33 includes an upper pivot-pin support 33U1 coupled to vertical frame plate 30 and an upper panel link 33U2 as suggested in FIG. 6. Upper panel link 33U2 includes an upper pin-carrier member 33U3 adapted to mate with an upper section of the hinge-side end 181H of main panel 181 and an upper pivot pin 33U4 cantilevered to a free end of upper pin-carrier member 33U3 and arranged to extend along vertical pivot axis 18A into a pin receiver formed in upper pivot-pin support 33U1.

Lower hinge 33L of gate-pivot support 33 includes a lower pivot-pin support 33L1 coupled to vertical frame plate 30 and a lower panel link 33L2 as suggested in FIG. 6. Lower panel link 33L2 includes a lower pin-carrier member 33L3 adapted to mate with a lower section of the hinge-side end 181H of main panel 181 and a lower pivot pin 33L4 cantilevered to a free end of lower pin-carrier member 33L3 and arranged to extend along vertical pivot axis 18A into a pin receiver formed in lower pivot-pin support 33L1.

Figure 5A:
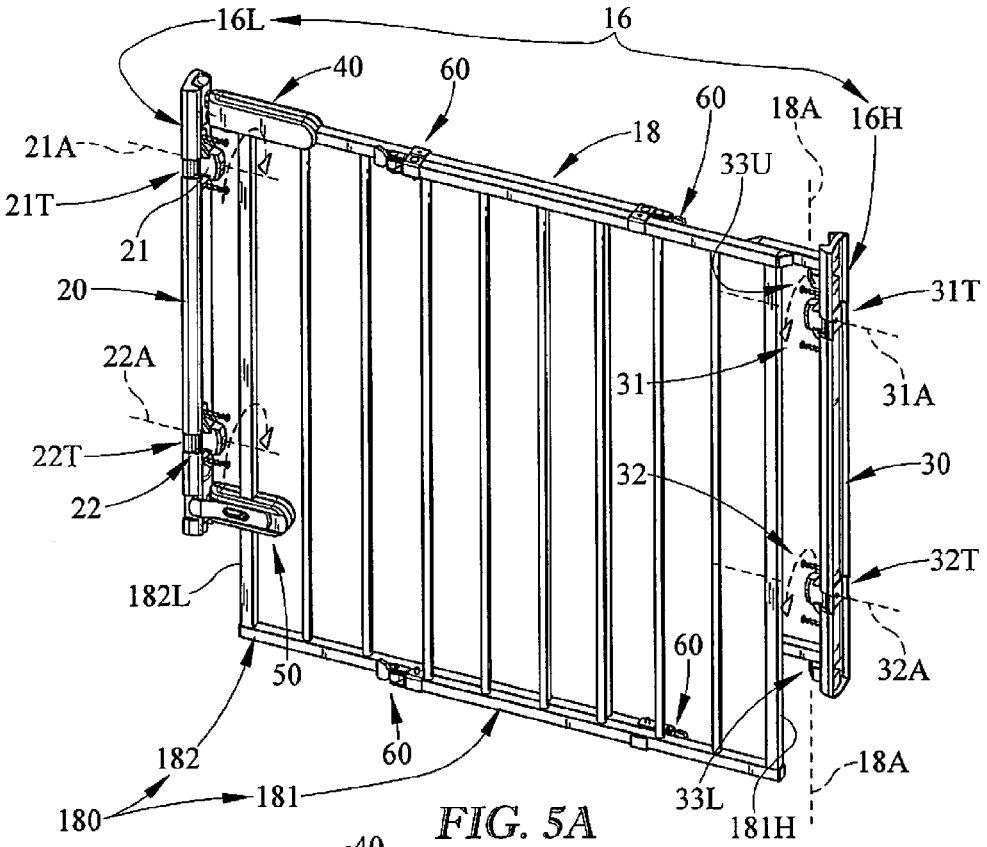
FIG. 5B is a perspective view similar to FIG. 5A showing that a gate-installation person has rotated each of the front rotatable anchors about its horizontal rotation axis in a clockwise direction through an angle of 90° (as shown in stages and in more detail in FIGS. 8-10) to assume a horizontal anchoring orientation.
Figure 5B:
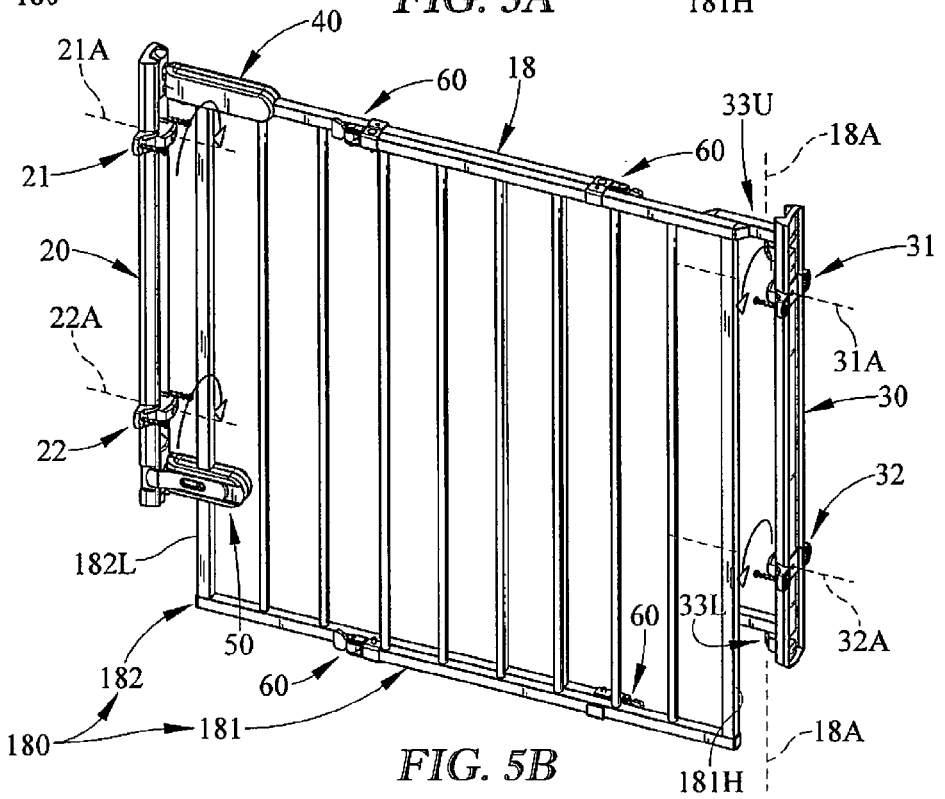

In illustrative embodiments, assembled gate unit 10 also includes a two-stage gate release 40, a bidirectional swing stop 50, and several panel-motion clamps 60 as shown, for example, in FIGS. 4, 5A, and 5B. Two-stage gate release 40 is coupled to an upper section of the lock-side end 181L of extension panel 181 of swinging gate 18 and to lock-side frame mount 16L and is configured to provide means for freeing a locked gate 18 to move from the closed position about vertical pivot axis 16A using a one-handed, dual-action manual input provided by a user that is gripping a portion of the two-stage gate release 40. Bidirectional swing stop 50 is coupled to a lower section of the lock-side end 181L of extension panel 181 of swinging gate 18 and to lock-side frame mount 16L and is configured to provide means for blocking (at the option of a user) either clockwise-swing overtravel of swinging gate 18 past the closed position or counterclockwise-swing overtravel of swinging gate 18. Each panel-motion clamp 60 is coupled to each of the main and extension panels 181, 182 and is configured to provide means for blocking relative movement of the main and extension panels 181, 182 to establish the width of barrier wall 180 and assembled gate unit 10.

Gate unit 10 includes a gate mount 16 that is adapted to mate with a door frame bordering a doorway, a hall frame bordering a hallway, or a staircase frame bordering an entry to a staircase. Gate mount 16 includes hinge-side frame mount 16H coupled to a hinge-side end 18H of gate 18 and adapted to mate with hinge-side frame portion 14H of the doorway, hallway, or staircase frame 14 as suggested in FIG. 4. Gate mount 16 also includes a lock-side frame mount 16L adapted to mate with an opposite lock-side frame portion 14L of the doorway, hallway or staircase frame 14 and to a lock-side end 18L of gate 18 when gate 18 is moved to assume the closed position as suggested in FIG. 4.

Gate unit 10 is pre-assembled at a factory and supported for shipping in gate-unit packaging 12 as a single unit using a gate spacer 103 provided between the lock-side frame mount 16L and the lock-side end 18L of gate 18 and two floor spacers 101, 102 provided along a bottom edge of gate 18. Zip-tie connectors 104, 105 are used to anchor the lock-side end 18L of gate 18 in a stationary position relative to the lock-side frame mount 16L and to trap gate spacer 103 in a fixed position between the lock-side frame mount 16L and the lock-side end 18L of the gate 18 as suggested in FIGS. 2 and 3.

In illustrative embodiments, during installation on a doorway, hallway, or staircase frame 14, the pre-assembled gate unit 10 is removed from shipping packaging 12 and gate spacer 103 is retained in a trapped position between the lock-side frame mount 16L and the lock-side edge 18L of gate 18 by means of zip-tie connectors 104, 105. The pre-assembled gate unit 10 is carried to a hallway, doorway, or staircase by a consumer. The two floor spacers 101, 102 that came in packaging 12 are placed on the floor (e.g. one adjacent to the lock-side frame mount 16L and the other adjacent to the hinge-side frame mount 16H) and the pre-assembled gate 10 is placed in an 140 opening provided between the lock-side and hinge-side frame mounts 16L, 16H and lowered to rest in a ready-to-install elevated position on the underlying floor spacers 101,102 that set on the underlying floor.

Lock-side vertical frame mount 16L includes a first vertical plate 20 and at least one rotatable frame anchor 21 (and 22) that is mounted on vertical plate 20 for rotation about a horizontal rotation axis 21A from a vertical shipping orientation aligned with first vertical plate 20 through a 90° angle to assume a horizontal anchoring orientation extended at a right angle to first vertical plate 20. Each rotatable frame anchor 21, 22 includes a rotating screw-carrier bracket 200 and two frame dog screws 201, 202 that are carried on the rotating screw-carrier bracket 200. The two frame dog screws 201, 202 are pre-installed at the factory and retained on the rotating screw-carrier bracket 200 during shipping. For example, the two frame dog screws 201, 202 are moved relative to first vertical plate 20 from a shipping position shown in FIG. 8 to a ready-to-engage-a-frame position shown in FIG. 10 during rotation of the rotatable frame anchor 21 about the first horizontal rotation axis 21A from the vertical shipping orientation shown in FIG. 8 to the horizontal anchoring orientation shown in FIG. 10.

A perspective assembly view of the first rotatable anchor 21 before it is coupled to a rotation-support sleeve 21S included in an upper portion of the lock-side vertical frame mount 16L is illustrated in FIG. 7. The first rotatable anchor 21 comprises a rotating screw-carrier bracket 200, two frame dog screws 201, 202 that are pre-installed and carried on the rotating screw-carrier bracket 203, and a sleeve cap 204 configured to mate with the rotation-support sleeve 21S and cooperate therewith to support the rotating screw-carrier bracket 200 for rotation about a horizontal rotation axis 21A.

First rotatable anchor 21 is arranged to lie in the vertical shipping orientation during shipping as suggested in FIG. 8. First rotatable anchor 21 also includes a fold-out paper pilot-hole template 21T comprising a foldable left-side flap 21T1 marked with a first pilot-hole mark for the first frame dog screw 201 and a foldable right-side flap 21T2 marked with a second pilot-hole mark for the second frame dog screw 202. Each flap 21T1, 21T2 can be pivoted outwardly toward a frame 14 (e.g., wall) by a gate installer once the lock-side vertical frame mount 16L is mated with the frame 14 to show where pilot holes should be drilled to receive the frame dog screws 201, 202 as suggested in FIGS. 8 and 9.

In illustrative embodiments, the following process is used to install an assembled gate unit 10 in accordance with the present disclosure in a door, hallway, or staircase frame 14. The assembled gate unit 10 is removed from the shipping packaging 12, placed in a doorway or opening 140, and adjusted to fit the width of the doorway or opening 140. Each rotatable frame anchor 21, 22, 31, and 32 is anchored to its companion frame portion 14H or 14L by unfolding a paper template 21T (see FIGS. 8 and 9), 22T, 31T, or 32T that is provided in the frame mount 16 for each rotatable frame anchor 21, 22, 31 and 32 as suggested in FIG. 5A to cause the paper template to lie along the adjacent frame portion 14H or 14L, pre-drilling fastener pilot holes in the adjacent frame portion 14H or 14L through drill-locator targets printed on the paper template, rotating the screw-carrier bracket 200 about its horizontal rotation axis to align each of the pre-installed frame dog screws 201, 202 with one of the pre-drilled fastener pilot holes, and driving each frame dog screw 201, 202 into a companion pre-drilled fastener pilot hole using a screw driver. Finally, the zip-tie connectors 104, 105 and the gate spacer 103 and floor spacers 101, 102 are removed from gate 18 and gate mount 16. Gate 18 is retained in the closed position using an on-board gate lock system coupled to the gate 18 and gate mount 16. The gate 18 is ready to be opened.

Gate unit 10 is shipped fully assembled in shipping gate-unit package 12 as suggested in FIG. 1. There are no loose parts contained in package 12 as gate unit 10 is pre-assembled at a factory so that even the eight screws 201, 202 that are provided for mounting are pre-installed on the four screw-carrier brackets 200 included in the rotatable frame anchors 21, 22, 31, and 32.

Some of the internal packaging 101, 102, 103 that protects the assembled gate unit 10 in package 12 during shipping doubles as an aid for installing the gate unit 10 as suggested in FIG. 3. Zip-tie connectors 104, 105 are used to hold movable panels 181, 182 included in swinging gate 18 to companion frame mounts 16H, 16L. Floor spacers 101, 102 lift gate unit 10 off of an underlying floor so that the user can install gate unit 10 at a recommended elevated height. Installation can be accomplished easily by one person. The fully assembled gate unit 10 stands on its own because the installation aids 101, 102 to assist the user in aligning the gate unit 10 properly in an opening 140. The fully assembled gate unit 10 allows the user to install gate unit 10 without having to measure and mark the height of the screw hole locations. The installation instructions 106 are printed on large thick paper and mounted to the gate exterior where they can be referenced easily during installation as shown, for example in FIG. 3.

A gate system 11 comprises a gate unit 10, gate-unit packaging 12, and various spacers 101, 102, and 103 to support gate unit 10 in packaging as suggested in FIG. 1. Spacers 101, 102, and 103 also support gate unit 10 during installation after removal from packaging 12 as suggested in FIGS. 2-4.

Gate unit 10 includes a gate mount 16 adapted to mate with a frame 14 bordering an opening 14O in a passageway and a gate 18 mounted on gate mount 16 for pivotable movement about a hinge-pivot axis 16A between opened and closed positions as suggested in FIG. 4. Gate mount 16 includes a hinge-side frame mount 16H coupled to a hinge-side end 18H of the gate 18 associated with hinge-pivot axis 16A and adapted to mate with a hinge-side frame portion 14H of frame 14 and a lock-side frame mount 16L adapted to mate with an opposite lock-side frame 14L portion of frame 14 and lie in a spaced-apart location to hinge-pivot axis 16A to locate the hinge-side end 18H of gate 18 therebetween as suggested in FIG. 4.

Lock-side frame mount 14L of frame 14 includes a first vertical frame plate 20, a first rotatable frame anchor 21, and a second rotatable frame anchor 22 as shown in FIG. 2. First vertical frame plate 20 is adapted to mate with the lock-side frame portion 14L of frame 14. First rotatable frame anchor 21 is mounted on first vertical frame plate 20 for rotation about a first horizontal rotation axis 21A from a vertical shipping orientation aligned in registry with first vertical frame plate 20 to a horizontal anchoring orientation as shown in FIGS. 8-10.

First rotatable frame anchor 21 includes a plate mount 203 arranged to intersect the first horizontal rotation axis 21A and a first fastener mount 201M as shown in FIG. 7. First fastener mount 201M is arranged to lie in confronting relation to first vertical frame plate 20 when first rotatable frame anchor 21 lies in the vertical shipping orientation as shown in FIG. 8 and to lie in spaced-apart relation to first vertical frame plate 20 to lie in confronting relation to lock-side frame portion 14L of frame 14 as shown in FIG. 10. First rotatable frame anchor 21 also includes first fastener 201 coupled to first fastener mount 201M to move therewith during rotation of first rotatable frame anchor 201 about the first horizontal rotation axis 21A between the vertical shipping orientation and the horizontal anchoring orientation as suggested in FIGS. 8-10. First fastener 201 is adapted to engage lock-side frame portion 14L of frame 14 to anchor first vertical plate 20 in a stationary position on lock-side frame portion 14L of frame 14 when first rotatable frame anchor 21 is in the horizontal anchoring orientation as suggested in FIG. 10.

First fastener mount 201M is cantilevered to plate mount 203 and arranged to extend in a first direction away from plate mount 203 as suggested in FIG. 7. First fastener 201 is coupled to a free end of first fastener mount 201 to lie at a fixed distance from the first horizontal rotation axis 21A during rotation of first rotatable frame anchor 21 about the first horizontal rotation axis 21A from the vertical shipping orientation to the horizontal anchoring orientation as shown in FIGS. 8-10.

First vertical frame plate 20 includes a first plate section 201P and a second plate section 202P arranged to lie in spaced-apart relation to the first plate section 201P to define a mount-receiver channel 203C therebetween as shown in FIG. 7. The first horizontal rotation axis 21A is arranged to extend through the mount-receiver channel 203C and lie in spaced-apart relation to each of the first and second plate sections 201P, 202P. First fastener mount 201M is arranged to mate with first plate section 201P when first rotatable frame anchor 21 is in the vertical shipping orientation as shown in FIG. 8 and to lie in spaced-apart relation to first plate section 201P to a first side of vertical frame plate 20 when first rotatable frame anchor 21 is in the horizontal anchoring orientation as shown in FIG. 10. Plate mount 203 includes a fastener-mount support 205 coupled to first fastener mount 201M and an anti-rotation piece 206 as shown in FIG. 7. Anti-rotation piece 206 is arranged to extend into the mount-receiver channel 203C to engage a barrier portion 20B of the vertical frame plate 20 to block rotation of first rotatable frame anchor 21 about the first horizontal rotation axis 21A when first rotatable frame anchor 21 is in the horizontal anchoring orientation as suggested in FIG. 10 and to exit the mount-receiver channel 203C to free the first rotatable frame anchor 21 to rotate about the first horizontal rotation axis 21A during movement between the horizontal anchoring orientation and the vertical shipping orientation as suggested in FIGS. 8-10. The anti-rotation piece 206 of plate mount 203 is also arranged to extend into the mount-receiver channel 203C to engage a barrier portion 20B (see FIG. 7) of the vertical frame plate 20 to block rotation of first rotatable frame anchor 21 about the first horizontal rotation axis 21A when first rotatable frame anchor 21 is in the vertical shipping orientation as suggested in FIG. 8.

First rotatable frame anchor 21 further includes a second fastener mount 202M cantilevered to plate mount 203 as shown in FIG. 7. Second fastener mount 202M is arranged to extend in an opposite second direction away from plate mount 203 to mate with second plate section 202P when first rotatable frame anchor 21 is in the vertical shipping orientation as shown in FIG. 8 and to lie in spaced-apart relation to second plate section 202P to an opposite second side of the vertical frame plate 20 when first rotatable frame anchor 21 is in the horizontal anchoring orientation as shown in FIG. 10.

First rotatable frame anchor 21 further includes a second fastener 202 coupled to second fastener mount 202M to move therewith during rotation of the first rotatable frame anchor 21 about the first horizontal rotation axis 21A between the vertical shipping orientation and the horizontal anchoring orientation. Second fastener 202 is adapted to engage the lock-side frame portion 14L of frame 14 to anchor first vertical plate 20 in the stationary position on the lock-side frame portion 14L of frame 14 when rotatable frame anchor 21 is in the horizontal anchoring orientation as suggested in FIGS. 2 and 4.

Lock-side frame mount 16L further includes a rotation-support post 21P coupled to vertical frame plate 20 and arranged to extend along the first horizontal rotation axis 21A as shown in FIG. 7. Plate mount 203 is mounted on the rotation-support post 21P for rotation about the first horizontal rotation axis 21A during change of first rotatable frame anchor 21 from the vertical shipping orientation to the horizontal anchoring orientation as suggested in FIGS. 8-10. Plate mount 203 is free to slide back and forth on the rotation-support post 21P along the first horizontal rotation axis 21A toward and away from first vertical frame plate 20 during change of first rotatable frame anchor 21 from the vertical shipping orientation to the horizontal anchoring orientation as suggested in FIGS. 5A and 5B.

Plate mount 203 includes a fastener-mount support 205 coupled to first fastener mount 201M and an anti-rotation piece 206 as shown in FIG. 7. Anti-rotation piece 206 is arranged to extend into the mount-receiver channel 203C to engage a barrier portion 20B of the vertical frame plate 20 to block rotation of first rotatable frame anchor 21 about the first horizontal rotation axis 21A when first rotatable frame anchor 21A is in the horizontal anchoring orientation and plate mount 203 is in a first position on the rotation-support post 21P as shown in FIG. 8 and to exit the mount-receiver channel 203C to free the first rotatable frame anchor 21 to rotate about the first horizontal rotation axis 21A without engaging the barrier portion 20B of the vertical frame plate 20 following sliding movement on the rotation-support post 21P away from vertical frame plate 20 during movement between the horizontal anchoring orientation and the vertical shipping orientation as suggested in FIG. 9.

Anti-rotation piece 206 includes a first edge E1 (see FIG. 7) that is arranged to engage barrier portion 20B of vertical frame plate 20 to block rotation of first rotatable anchor 21 about the first horizontal rotation axis 21A only when first rotatable frame anchor 21 is in the horizontal anchoring orientation as suggested in FIG. 10 and a separate second edge E2 (see FIG. 7) that is arranged to engage barrier portion 20B of vertical frame plate 20 to block rotation of first rotatable frame anchor 21 about the first horizontal rotation axis 21A only when the first rotatable frame anchor 21 is in the vertical shipping orientation as suggested in FIG. 8. First and second edges E1, E2 cooperate to form an included angle therebetween of about 90 degrees as shown in FIG. 7. First edge E1 is arranged to face toward the first fastener mount 201M and the second edge E2 arranged to lie in substantially perpendicular relation to the first edge E1 as shown in FIG. 7.

Gate system 11 also includes gate-unit packaging 12 and first and second floor spacers 101, 102 as suggested in FIGS. 1-3. Gate-unit packaging 12 is formed to include an interior region 12I containing the gate unit 10 in a pre-assembled shipping configuration in which gate 18 is mounted on gate mount 16 and located in the closed position as shown in FIG. 1. First floor spacer 101 is associated with lock-side frame mount 16L and arranged to engage the bottom edge of gate unit 10 and the companion interior surface of the bottom wall 12B of gate-unit packaging 12 underlying the bottom edge of gate unit 10 as shown in FIG. 1. Second floor spacer 102 is associated with the hinge-side frame mount 16H and arranged to engage a bottom edge of gate unit 10 and a companion interior surface of bottom wall 10 of the gate-unit packaging 12 as also shown in FIG. 1.

First and second floor spacers 101, 102 cooperate to provide elevation-support means (1) for engaging a floor F underlying the gate unit 10 after the gate unit 10 and first and second floor spacers 101, 102 have been removed from the gate-unit packaging 12 and aligned with the lock-side and hinge-side portions 14L, 14H of a frame 14 bordering an opening 14O into a passageway to cause the gate mount 16 of the gate unit 10 to mate with the frame 14 bordering the opening 14O and (2) for supporting the gate unit 10 in an elevated position above the floor F during rotation of the first rotatable frame anchor 21 about the first horizontal rotation axis 21A from the vertical shipping orientation to the horizontal anchoring orientation so that first fastener 201 can be moved relative to first fastener mount 201M to engage lock-side frame portion 14L of frame 14 upon arrival of first rotatable frame anchor 21 at the horizontal anchoring orientation to anchor first vertical plate 20 in the stationary position on the first side of frame 14 before and after separation of the first and second floor spacers 101, 102 from the gate unit 10 as suggested in FIGS. 2-4.

Hinge-side frame mount 16H includes a second vertical frame plate 30 that is adapted to mate with the hinge-side frame portion 14H of the frame 14 and a second rotatable frame anchor 32 as shown in FIG. 4. Second rotatable frame anchor 32 is mounted on the second vertical frame plate 30 for rotation about a second horizontal rotation axis 32A from a vertical shipping orientation aligned in registry with the second vertical frame plate 30 as shown in FIG. 5A to a horizontal anchoring orientation as shown in FIG. 5B. Second rotatable frame anchor 32 includes a plate mount 203 arranged to intersect the second horizontal rotation axis 32A and a first fastener mount 201M arranged to lie in confronting relation to the second vertical frame plate 30 when the second rotatable frame anchor 32 lies in the vertical shipping orientation as shown in FIG. 5A and to lie in spaced-apart relation to the second vertical frame plate 30 to lie in confronting relation to the hinge-side frame portion 14H of the frame 14. Second rotatable frame anchor 32 also includes a first fastener 201 coupled to the first fastener mount 201M to move therewith during rotation of the second rotatable frame anchor 32 about the second horizontal rotation axis 32A between the vertical shipping orientation and the horizontal anchoring orientation as suggested in FIGS. 2-4. First fastener 201M is adapted to engage the hinge-side frame portion 14H of the frame 14 to anchor the second vertical plate 30 in a stationary position on the hinge-side frame portion 14H of the frame 14 when the second rotatable frame anchor 22 is in the horizontal anchoring orientation as shown in FIG. 4. First and second floor spacers 101, 102 cooperate to provide elevation-support means for supporting gate unit 10 in an elevated position above the floor F after the gate unit 10 and first and second floor spacers 101, 102 have been removed from gate-unit packaging 12 and aligned with lock-side and hinge-side frame portions 14L, 14H of a frame 14 bordering a passageway 140 during rotation of the second rotatable frame anchor 32 about the second horizontal rotation axis 32A from the vertical shipping orientation to the horizontal anchoring orientation as suggested in FIGS. 2-4 so that the first fastener 201 can be moved relative to the first fastener mount 201M to engage the hinge-side frame portion 14H of the frame 14 upon arrival of the second rotatable frame anchor 32 at the horizontal anchoring orientation to anchor the second vertical plate 30 in the stationary position on the hinge-side frame portion 14H of the frame 14 before and after separation of the first and second floor spacers 101, 102 from the gate unit 10.

First floor spacer 101 is also arranged to engage the hinge-side frame mount 14H and a companion interior surface of a first side wall 12S1 of the gate-unit packaging 12 as shown in FIG. 1. Second floor spacer 102 is also arranged to engage the lock-side frame mount 14L and a companion interior surface of a second side wall 12S2 of the gate-unit packaging 10 that is arranged to lie in laterally spaced-apart opposing relation to the interior surface of the first side wall 12S1.

Each of the first and second floor spacers 101, 102 is L-shaped as shown in FIG. 2. First floor spacer 101 is also arranged to engage the hinge-side frame mount 14H and a companion first interior side wall 12S1 of the gate-unit packaging 12 as suggested in FIG. 1. Second floor spacer 102 is also arranged to engage a companion second interior side wall 12S2 of the gate-unit packaging 12. First floor spacer 101 is arranged to engage a first side edge of the gate 18 and floor spacer 102 is arranged to engage an opposite second side edge of the gate 18 as suggested in FIGS. 1 and 3.

First floor spacer 101 is arranged to underlie and engage the hinge-side frame mount 14H and second floor spacer 102 is arranged to underlie and engage the lock-side frame mount 14L as shown in FIGS. 1 and 3. First floor spacer 101 is also arranged to engage a companion interior surface of a first side wall 12S1 of the gate-unit packaging 12. Second floor spacer 102 is arranged to engage a companion interior surface of a second side wall 12S2 of the gate-unit packaging 12. First floor spacer 101 is arranged to engage a first side edge of the gate 18 and second floor spacer 102 is arranged to engage an opposite second side edge of the gate 18 as shown in FIGS. 1 and 3.

Gate system 11 also includes a gate spacer 103 and a connector 104 (or 105) as shown in FIGS. 1-3. Gate spacer 103 is arranged to lie temporarily between and engagement with the lock-side frame mount 16L and the gate 18 while the gate unit 10 remains in the interior region 12I of the gate-unit packaging 12 as shown in FIG. 1. Connector 104 is coupled to each of the lock-side frame mount 16L and a lock-side end 18E of the gate 18 to anchor the lock-side end of the gate 18 to the lock-side frame mount 16L and trap the gate spacer 103 in a fixed position between the lock-side frame mount 16L and the lock-side end 18L of the gate 18 as suggested in FIGS. 1-3.

Hinge-side frame mount 16H includes a vertical frame plate 30 that is adapted to mate with the hinge-side frame portion 14H of frame 14 and a first rotatable frame anchor 31 mounted on vertical frame plate 30 for rotation about a first horizontal rotation axis 31A from a vertical shipping orientation aligned in registry with vertical frame plate 30 to a horizontal anchoring orientation as suggested in FIGS. 5A and 5B. First rotatable frame anchor 31 includes a plate mount 203 arranged to intersect the first horizontal rotation axis 21A and a first fastener mount 201M arranged to lie in confronting relation to vertical frame plate 30 when first rotatable frame 21 anchor lies in the vertical shipping orientation and to lie in spaced-apart relation to vertical frame plate 30 to lie in confronting relation to the hinge-side frame portion 14H of frame 14 as shown in FIG. 5A. First rotatable frame anchor 31 also includes a first fastener 201 coupled to first fastener mount 201M to move therewith during rotation of first rotatable frame anchor 31 about the first horizontal rotation axis 31A between the vertical shipping orientation and the horizontal anchoring orientation as shown in FIGS. 5A and 5B and adapted to engage the hinge-side frame portion 14H of the frame to anchor the vertical frame plate 30 in a stationary position on the hinge-side frame portion 14H of frame 14H when the first rotatable frame anchor 31 is in the horizontal anchoring orientation as shown in FIG. 5B.

First fastener mount 201M is cantilevered to plate mount 203 and arranged to extend in a first direction away from plate mount 203. First fastener 201 is coupled to a free end of the first fastener mount 201M to lie at a fixed distance from the first horizontal rotation axis 31A during rotation of the first rotatable frame anchor 31 about the first horizontal rotation axis 31A from the vertical shipping orientation to the horizontal anchoring orientation as suggested in FIGS. 5A and 5B.

Vertical frame plate 30 includes a first plate section 201P and a second plate section 202P arranged to lie in spaced-apart relation to the first plate section 201P to define a mount-receiver channel 203C therebetween. The first horizontal rotation axis 31A is arranged to extend through the mount-receiver channel 203C and lie in spaced-apart relation to each of the first and second plate sections 201P, 202P. First fastener mount 201M is arranged to mate with first plate section 201P when first rotatable frame anchor 31 is in the vertical shipping orientation and to lie in spaced-apart relation to first plate section 201P to a first side of the vertical frame plate 30 when first rotatable frame anchor 31 is in the horizontal anchoring orientation. Plate mount 203 includes a fastener-mount 205 support coupled to the first fastener mount 201M and an anti-rotation piece 206 arranged to extend into the mount-receiver channel 203C to engage a portion of the vertical frame plate 30 to block rotation of first rotatable frame anchor 31 about the first horizontal rotation axis 31A when first rotatable frame anchor 31 is in the horizontal anchoring orientation and to exit the mount-receiver channel 203C to free the first rotatable frame anchor 31 to rotate about the first horizontal rotation axis 31A during movement between the horizontal anchoring orientation and the vertical shipping orientation.

Gate-unit packaging 12 is formed to include an interior region 12I containing the gate unit 10 in a pre-assembled shipping configuration in which the gate 18 is mounted on the gate mount 16 and located in the closed position as suggested in FIG. 1. First floor spacer 101 is associated with the lock-side frame mount 14L and arranged to engage the bottom edge of the gate unit 10 and the companion interior surface of the bottom wall 12B of the gate-unit packaging 12 underlying the bottom edge of the gate unit 10 as suggested in FIG. 1. Second floor spacer 102 is associated with the hinge-side frame mount 14H and arranged to engage a bottom edge of the gate unit 10 and a companion interior surface of bottom wall 12B of the gate-unit packaging 12. First and second floor spacers 101, 102 cooperate to provide elevation-support means for engaging a floor F underlying the gate unit 10 after the gate unit 10 and first and second floor spacers 101, 102 have been removed from the gate-unit packaging 12 and aligned with the lock-side and hinge-side portions 14L, 14H of a frame 14 bordering an opening 14O into a passageway to cause gate mount 16 of gate unit 10 to mate with the frame 14 bordering the opening 14O and for supporting the gate unit 10 in an elevated position above the floor F during anchoring of gate mount 16 to frame 14 to establish the elevated position of gate unit 10 so that the first and second floor spacers 101, 102 are used to support the gate unit 10 in gate-unit packaging 12 and repurposed after removal of gate unit 10 from gate-unit packaging 12 to support gate unit 10 in the elevated position while the gate mount 10 is being anchored to the frame 14.

The invention claimed is:

1. A gate system comprising a gate unit including a gate mount adapted to mate with a frame bordering a passageway and a gate mounted on the gate mount for pivotable movement about a hinge-pivot axis between opened and closed positions, the gate mount includes a hinge-side frame mount coupled to a hinge-side end of the gate associated with the hinge-pivot axis and adapted to mate with a hinge-side frame portion of the frame and a lock-side frame mount adapted to mate with an opposite lock-side frame portion of the frame and lie in a spaced-apart location to the hinge-pivot axis to locate the hinge-side end of the gate therebetween, and the lock-side frame mount includes a first vertical frame plate that is adapted to mate with the lock-side frame portion of the frame and a first rotatable frame anchor mounted on the first vertical frame plate for rotation about a first horizontal rotation axis from a vertical shipping orientation aligned in registry with the first vertical frame plate to a horizontal anchoring orientation, the first rotatable frame anchor includes a plate mount arranged to intersect the first horizontal rotation axis, a first fastener mount arranged to lie in confronting relation to the first vertical frame plate when the first rotatable frame anchor lies in the vertical shipping orientation and to lie in spaced-apart relation to the first vertical frame plate in confronting relation to the lock-side frame portion of the frame, and a first fastener coupled to the first fastener mount and spaced apart from the first horizontal rotation axis to move therewith during rotation of the first rotatable frame anchor about the first horizontal rotation axis between the vertical shipping orientation and the horizontal anchoring orientation and adapted to engage the lock-side frame portion of the frame to anchor the first vertical plate in a stationary position on the lock-side frame portion of the frame when the first rotatable frame anchor is in the horizontal anchoring orientation.

2. The gate system of claim 1, wherein the lock-side frame mount further includes a rotation-support post coupled to the vertical frame plate and arranged to extend along the first horizontal rotation axis and the plate mount is mounted on the rotation-support post for rotation about the first horizontal rotation axis during change of the first rotatable frame anchor from the vertical shipping orientation to the horizontal anchoring orientation.

3. The gate system of claim 2, wherein the plate mount is free to slide back and forth on the rotation-support post along the first horizontal rotation axis toward and away from the first vertical frame plate during change of the first rotatable frame anchor from the vertical shipping orientation to the horizontal anchoring orientation.

4. The gate system of claim 3, wherein the plate mount includes a fastener-mount support coupled to the first fastener mount and an anti-rotation piece arranged to extend into the mount-receiver channel to engage a barrier portion of the vertical frame plate to block rotation of the first rotatable frame anchor about the first horizontal rotation axis when the first rotatable frame anchor is in the horizontal anchoring orientation and the plate mount is in a first position on the rotation-support post and to exit the mount-receiver channel to free the first rotatable frame anchor to rotate about the first horizontal rotation axis without engaging the barrier portion of the vertical frame plate following sliding movement on the rotation-support post away from the vertical frame plate during movement between the horizontal anchoring orientation and the vertical shipping orientation.

5. The gate system of claim 4, wherein the anti-rotation piece includes a first edge that is arranged to engage the barrier portion of the vertical frame plate to block rotation of the first rotatable anchor about the first horizontal rotation axis only when the first rotatable frame anchor is in the horizontal anchoring orientation and a separate second edge that is arranged to engage the barrier portion of the vertical frame plate to block rotation of the first rotatable frame anchor about the first horizontal rotation axis only when the first rotatable frame anchor is in the vertical shipping orientation.

6. The gate system of claim 5, wherein the first and second edges cooperate to form an included angle therebetween of about 90 degrees.

7. The gate system of claim 5, wherein the first edge is arranged to face toward the first fastener mount and the second edge arranged to lie in substantially perpendicular relation to the first edge.

8. A gate system comprising a gate unit including a gate mount adapted to mate with a frame bordering a passageway and a gate mounted on the gate mount for pivotable movement about a hinge-pivot axis between opened and closed positions, the gate mount includes a hinge-side frame mount coupled to a hinge-side end of the gate associated with the hinge-pivot axis and adapted to mate with a hinge-side frame portion of the frame and a lock-side frame mount adapted to mate with an opposite lock-side frame portion of the frame and lie in a spaced-apart location to the hinge-pivot axis to locate the hinge-side end of the gate therebetween, and the lock-side frame mount includes a first vertical frame plate that is adapted to mate with the lock-side frame portion of the frame and a first rotatable frame anchor mounted on the first vertical frame plate for rotation about a first horizontal rotation axis from a vertical shipping orientation aligned in registry with the first vertical frame plate to a horizontal anchoring orientation, the first rotatable frame anchor includes a plate mount arranged to intersect the first horizontal rotation axis, a first fastener mount arranged to lie in confronting relation to the first vertical frame plate when the first rotatable frame anchor lies in the vertical shipping orientation and to lie in spaced-apart relation to the first vertical frame plate in confronting relation to the lock-side frame portion of the frame, and a first fastener coupled to the first fastener mount to move therewith during rotation of the first rotatable frame anchor about the first horizontal rotation axis between the vertical shipping orientation and the horizontal anchoring orientation and adapted to engage the lock-side frame portion of the frame to anchor the first vertical plate in a stationary position on the lock-side frame portion of the frame when the first rotatable frame anchor is in the horizontal anchoring orientation, wherein the first fastener mount is cantilevered to the plate mount and arranged to extend in a first direction away from the plate mount and the first fastener is coupled to a free end of the first fastener mount to lie at a fixed distance from the first horizontal rotation axis during rotation of the first rotatable frame anchor about the first horizontal rotation axis from the vertical shipping orientation to the horizontal anchoring orientation.

9. The gate system of claim 8, wherein the first vertical frame plate includes a first plate section and a second plate section arranged to lie in spaced-apart relation to the first plate section to define a mount-receiver channel therebetween, the first horizontal rotation axis is arranged to extend through the mount-receiver channel and lie in spaced-apart relation to each of the first and second plate sections, the first fastener mount is arranged to mate with the first plate section when the first rotatable frame anchor is in the vertical shipping orientation and to lie in spaced-apart relation to the first plate section to a first side of the vertical frame plate when the first rotatable frame anchor is in the horizontal anchoring orientation, and the plate mount includes a fastener-mount support coupled to the first fastener mount and an anti-rotation piece arranged to extend into the mount-receiver channel to engage a barrier portion of the vertical frame plate to block rotation of the first rotatable frame anchor about the first horizontal rotation axis when the first rotatable frame anchor is in the horizontal anchoring orientation and to exit the mount-receiver channel to free the first rotatable frame anchor to rotate about the first horizontal rotation axis during movement between the horizontal anchoring orientation and the vertical shipping orientation.

10. The gate system of claim 9, wherein the anti-rotation piece of the plate mount is also arranged to extend into the mount-receiver channel to engage a barrier portion of the vertical frame plate to block rotation of the first rotatable frame anchor about the first horizontal rotation axis when the first rotatable frame anchor is in the vertical shipping orientation.

11. The gate system of claim 9, wherein the first rotatable frame anchor further includes a second fastener mount cantilevered to the plate mount and arranged to extend in an opposite second direction away from the plate mount to mate with the second plate section when the first rotatable frame anchor is in the vertical shipping orientation and to lie in spaced-apart relation to the second plate section to an opposite second side of the vertical frame plate when the first rotatable frame anchor is in the horizontal anchoring orientation.

12. The gate system of claim 11, wherein the first rotatable frame anchor further includes a second fastener coupled to the second fastener mount to move therewith during rotation of the first rotatable frame anchor about the first horizontal rotation axis between the vertical shipping orientation and the horizontal anchoring orientation and adapted to engage the lock-side frame portion of the frame to anchor the first vertical plate in the stationary position on the lock-side frame portion of the frame when the rotatable frame anchor is in the horizontal anchoring orientation.

13. A gate system comprising a gate unit including a gate mount adapted to mate with a frame bordering a passageway and a gate mounted on the gate mount for pivotable movement about a hinge-pivot axis between opened and closed positions, the gate mount includes a hinge-side frame mount coupled to a hinge-side end of the gate associated with the hinge-pivot axis and adapted to mate with a hinge-side frame portion of the frame and a lock-side frame mount adapted to mate with an opposite lock-side frame portion of the frame and lie in a spaced-apart location to the hinge-pivot axis to locate the hinge-side end of the gate therebetween, and the lock-side frame mount includes a first vertical frame plate that is adapted to mate with the lock-side frame portion of the frame and a first rotatable frame anchor mounted on the first vertical frame plate for rotation about a first horizontal rotation axis from a vertical shipping orientation aligned in registry with the first vertical frame plate to a horizontal anchoring orientation, the first rotatable frame anchor includes a plate mount arranged to intersect the first horizontal rotation axis, a first fastener mount arranged to lie in confronting relation to the first vertical frame plate when the first rotatable frame anchor lies in the vertical shipping orientation and to lie in spaced-apart relation to the first vertical frame plate in confronting relation to the lock-side frame portion of the frame, and a first fastener coupled to the first fastener mount to move therewith during rotation of the first rotatable frame anchor about the first horizontal rotation axis between the vertical shipping orientation and the horizontal anchoring orientation and adapted to engage the lock-side frame portion of the frame to anchor the first vertical plate in a stationary position on the lock-side frame portion of the frame when the first rotatable frame anchor is in the horizontal anchoring orientation, further comprising gate-unit packaging formed to include an interior region containing the gate unit in a pre-assembled shipping configuration in which the gate is mounted on the gate mount and located in the closed position, a first floor spacer associated with the lock-side frame mount and arranged to engage the bottom edge of the gate unit and the companion interior surface of the bottom wall of the gate-unit packaging underlying the bottom edge of the gate unit, and a second floor spacer associated with the hinge-side frame mount and arranged to engage the bottom edge of the gate unit and a companion interior surface of a bottom wall of the gate-unit packaging.

14. The gate system of claim 13, wherein the first and second floor spacers cooperate to provide elevation-support means for engaging a floor underlying the gate unit after the gate unit and first and second floor spacers have been removed from the gate-unit packaging and aligned with the lock-side and hinge-side portions of a frame bordering an opening into a passageway to cause the gate mount of the gate unit to mate with the frame bordering the opening and for supporting the gate unit in an elevated position above the floor during rotation of the first rotatable frame anchor about the first horizontal rotation axis from the vertical shipping orientation to the horizontal anchoring orientation so that the first fastener can be moved relative to the first fastener mount to engage the lock-side frame portion of the frame upon arrival of the first rotatable frame anchor at the horizontal anchoring orientation to anchor the first vertical plate in the stationary position on the first side of the frame before and after separation of the first and second floor spacers from the gate unit.

15. The gate system of claim 14, wherein the hinge-side frame mount includes a second vertical frame plate that is adapted to mate with the hinge-side frame portion of the frame and a second rotatable frame anchor mounted on the second vertical frame plate for rotation about a second horizontal rotation axis from a vertical shipping orientation aligned in registry with the second vertical frame plate to a horizontal anchoring orientation, the second rotatable frame anchor includes a plate mount arranged to intersect the second horizontal rotation axis, a first fastener mount arranged to lie in confronting relation to the second vertical frame plate when the second rotatable frame anchor lies in the vertical shipping orientation and to lie in spaced-apart relation to the second vertical frame plate to lie in confronting relation to the hinge-side frame portion of the frame, and a first fastener coupled to the first fastener mount to move therewith during rotation of the second rotatable frame anchor about the second horizontal rotation axis between the vertical shipping orientation and the horizontal anchoring orientation and adapted to engage the hinge-side frame portion of the frame to anchor the second vertical plate in a stationary position on the hinge-side frame portion of the frame when the second rotatable frame anchor is in the horizontal anchoring orientation, and the first and second floor spacers cooperate to provide elevation-support means for supporting the gate unit in an elevated position above the floor after the gate unit and first and second floor spacers have been removed from the gate-unit packaging and aligned with the lock-side and hinge-side frame portions of a frame bordering a passageway during rotation of the second rotatable frame anchor about the second horizontal rotation axis from the vertical shipping orientation to the horizontal anchoring orientation so that the first fastener can be moved relative to the first fastener mount to engage the hinge-side frame portion of the frame upon arrival of the second rotatable frame anchor at the horizontal anchoring orientation to anchor the second vertical plate in the stationary position on the hinge-side frame portion of the frame before and after separation of the first and second floor spacers from the gate unit.

16. The gate system of claim 13, wherein the first floor spacer is also arranged to engage the hinge-side frame mount and a companion interior surface of a first side wall of the gate-unit packaging.

17. The gate system of claim 16, wherein the second floor spacer is also arranged to engage the lock-side frame mount and a companion interior surface of a second side wall of the gate-unit packaging that is arranged to lie in laterally spaced-apart opposing relation to the interior surface of the first side wall.

18. The gate system of claim 17, wherein each of the first and second floor spacers is L-shaped.

19. The gate system of claim 13, wherein each of the first and second floor spacers is L-shaped, the first floor spacer is also arranged to engage the hinge-side frame mount and a companion first interior side wall of the gate-unit packaging, and the second floor spacer is also arranged to engage a companion second interior side wall of the gate-unit packaging.

20. The gate system of claim 19, wherein the first floor spacer is arranged to engage a first side edge of the gate and the second floor spacer is arranged to engage an opposite second side edge of the gate.

21. The gate system of claim 13, wherein the first floor spacer is arranged to underlie and engage the hinge-side frame mount and the second floor spacer is arranged to underlie and engage the lock-side frame mount.

22. The gate system of claim 21, wherein the first floor spacer is also arranged to engage a companion interior surface of a first side wall of the gate-unit packaging and the second floor spacer is arranged to engage a companion interior surface of a second side wall of the gate-unit packaging.

23. The gate system of claim 22, wherein the first floor spacer is arranged to engage a first side edge of the gate and the second floor spacer is arranged to engage an opposite second side edge of the gate.

24. The gate system of claim 13, further comprising a gate spacer arranged to lie temporarily between and engagement with the lock-side frame mount and the gate while the gate unit remains in the interior region of the gate-unit packaging.

25. The gate system of claim 24, further comprising a connector coupled to each of the lock-side frame mount and a lock-side end of the gate to anchor the lock-side end of the gate to the lock-side frame mount and trap the gate spacer in a fixed position between the lock-side frame mount and the lock-side end of the gate.

26. A gate system comprising a gate unit including a gate mount adapted to mate with a frame bordering a passageway and a gate mounted on the gate mount for pivotable movement about a hinge-pivot axis between opened and closed positions, the gate mount includes a hinge-side frame mount coupled to a hinge-side end of the gate associated with the hinge-pivot axis and adapted to mate with a hinge-side frame portion of the frame and a lock-side frame mount adapted to mate with an opposite lock-side frame portion of the frame and lie in a spaced-apart location to the hinge-pivot axis to locate the hinge-side end of the gate therebetween, the hinge-side frame mount includes a vertical frame plate that is adapted to mate with the hinge-side frame portion of the frame and a first rotatable frame anchor mounted on the vertical frame plate for rotation about a first horizontal rotation axis from a vertical shipping orientation aligned in registry with the vertical frame plate to a horizontal anchoring orientation, the first rotatable frame anchor includes a plate mount arranged to intersect the first horizontal rotation axis, a first fastener mount arranged to lie in confronting relation to the vertical frame plate when the first rotatable frame anchor lies in the vertical shipping orientation and to lie in spaced-apart relation to the vertical frame plate in confronting relation to the hinge-side frame portion of the frame, and a first fastener coupled to the first fastener mount and spaced apart from the first horizontal rotation axis to move therewith during rotation of the first rotatable frame anchor about the first horizontal rotation axis between the vertical shipping orientation and the horizontal anchoring orientation and adapted to engage the hinge-side frame portion of the frame to anchor the vertical frame plate in a stationary position on the hinge-side frame portion of the frame when the first rotatable frame anchor is in the horizontal anchoring orientation.

27. A gate system comprising a gate unit including a gate mount adapted to mate with a frame bordering a passageway and a gate mounted on the gate mount for pivotable movement about a hinge-pivot axis between opened and closed positions, the gate mount includes a hinge-side frame mount coupled to a hinge-side end of the gate associated with the hinge-pivot axis and adapted to mate with a hinge-side frame portion of the frame and a lock-side frame mount adapted to mate with an opposite lock-side frame portion of the frame and lie in a spaced-apart location to the hinge-pivot axis to locate the hinge-side end of the gate therebetween, the hinge-side frame mount includes a vertical frame plate that is adapted to mate with the hinge-side frame portion of the frame and a first rotatable frame anchor mounted on the vertical frame plate for rotation about a first horizontal rotation axis from a vertical shipping orientation aligned in registry with the vertical frame plate to a horizontal anchoring orientation, the first rotatable frame anchor includes a plate mount arranged to intersect the first horizontal rotation axis, a first fastener mount arranged to lie in confronting relation to the vertical frame plate when the first rotatable frame anchor lies in the vertical shipping orientation and to lie in spaced-apart relation to the vertical frame plate in confronting relation to the hinge-side frame portion of the frame, and a first fastener coupled to the first fastener mount to move therewith during rotation of the first rotatable frame anchor about the first horizontal rotation axis between the vertical shipping orientation and the horizontal anchoring orientation and adapted to engage the hinge-side frame portion of the frame to anchor the vertical frame plate in a stationary position on the hinge-side frame portion of the frame when the first rotatable frame anchor is in the horizontal anchoring orientation, wherein the first fastener mount is cantilevered to the plate mount and arranged to extend in a first direction away from the plate mount and the first fastener is coupled to a free end of the first fastener mount to lie at a fixed distance from the first horizontal rotation axis during rotation of the first rotatable frame anchor about the first horizontal rotation axis from the vertical shipping orientation to the horizontal anchoring orientation.

28. The gate system of claim 27, wherein the vertical frame plate includes a first plate section and a second plate section arranged to lie in spaced-apart relation to the first plate section to define a mount-receiver channel therebetween, the first horizontal rotation axis is arranged to extend through the mount-receiver channel and lie in spaced-apart relation to each of the first and second plate sections, the first fastener mount is arranged to mate with the first plate section when the first rotatable frame anchor is in the vertical shipping orientation and to lie in spaced-apart relation to the first plate section to a first side of the vertical frame plate when the first rotatable frame anchor is in the horizontal anchoring orientation, and the plate mount includes a fastener-mount support coupled to the first fastener mount and an anti-rotation piece arranged to extend into the mount-receiver channel to engage a portion of the vertical frame plate to block rotation of the first rotatable frame anchor about the first horizontal rotation axis when the first rotatable frame anchor is in the horizontal anchoring orientation and to exit the mount-receiver channel to free the first rotatable frame anchor to rotate about the first horizontal rotation axis during movement between the horizontal anchoring orientation and the vertical shipping orientation.

29. A gate system comprising a gate unit including a gate mount adapted to mate with a frame bordering a passageway and a gate mounted on the gate mount for pivotable movement about a hinge-pivot axis between opened and closed positions, the gate mount includes a hinge-side frame mount coupled to a hinge-side end of the gate associated with the hinge-pivot axis and adapted to mate with a hinge-side frame portion of the frame and a lock-side frame mount adapted to mate with an opposite lock-side frame portion of the frame and lie in a spaced-apart location to the hinge-pivot axis to locate the hinge-side end of the gate therebetween, and gate-unit packaging formed to include an interior region containing the gate unit in a pre-assembled shipping configuration in which the gate is mounted on the gate mount and located in the closed position, a first floor spacer associated with the lock-side frame mount and arranged to engage a bottom edge of the gate unit and a companion interior surface of a bottom wall of the gate-unit packaging underlying the bottom edge of the gate unit, and a second floor spacer associated with the hinge-side frame mount and arranged to engage the bottom edge of the gate unit and a companion interior surface of the bottom wall of the gate-unit packaging, wherein the first and second floor spacers cooperate to provide elevation-support means for engaging a floor underlying the gate unit after the gate unit and first and second floor spacers have been removed from the gate-unit packaging and aligned with the lock-side and hinge-side portions of the frame bordering an opening into the passageway to cause the gate mount of the gate unit to mate with the frame bordering the opening and for supporting the gate unit in an elevated position above the floor during anchoring of the gate mount to the frame to establish the elevated position of the gate unit so that the first and second floor spacers are used to support the gate unit in the gate-unit packaging and repurposed after removal of the gate unit from the gate-unit packaging to support the gate unit in the elevated position while the gate mount is being anchored to the frame.

* * * * *